US011772237B2

(12) United States Patent
Mirkovic

(10) Patent No.: US 11,772,237 B2
(45) Date of Patent: Oct. 3, 2023

(54) SANDING DEVICES FOR SANDING A WORKPIECE

(71) Applicant: Ivan Mirkovic, Mississauga (CA)

(72) Inventor: Ivan Mirkovic, Mississauga (CA)

(73) Assignee: Ivan Mirkovic, Mississauga (CA)

( * ) Notice: Subject to any disclaimer, the term of this patent is extended or adjusted under 35 U.S.C. 154(b) by 820 days.

(21) Appl. No.: 16/867,593

(22) Filed: May 6, 2020

(65) Prior Publication Data

US 2020/0361060 A1 Nov. 19, 2020

Related U.S. Application Data

(60) Provisional application No. 62/849,232, filed on May 17, 2019.

(51) Int. Cl.
*B24D 15/04* (2006.01)
*B24D 11/00* (2006.01)

(52) U.S. Cl.
CPC ..... *B24D 15/045* (2013.01); *B24D 11/00* (2013.01)

(58) Field of Classification Search
CPC ..... B24D 15/045; B24D 15/00; B24D 11/00; B24D 11/001; A41D 19/0037; A47L 13/18; A47L 13/44; A47L 23/10; A47L 17/08
USPC ..... 451/523, 913; 15/227, 244.1, 231, 15/229.11; 2/161.6
See application file for complete search history.

(56) References Cited

U.S. PATENT DOCUMENTS 2,256,098 A * 9/1941 Mauldin ..... A47L 13/18 D8/94
3,885,249 A * 5/1975 De Brabander ..... A47L 13/18 2/917
4,516,774 A * 5/1985 Nankivell ..... A63B 60/40 473/518
5,134,809 A * 8/1992 Morton ..... B24D 11/00 451/523
5,441,355 A * 8/1995 Moore ..... A47K 7/03 401/7

(Continued)

FOREIGN PATENT DOCUMENTS

FR 2680092 A1 * 2/1993 ..... A47K 7/02

OTHER PUBLICATIONS

FR2680092A1 English Translation (Year: 1993).*

*Primary Examiner* — Joel D Crandall
*Assistant Examiner* — Makena S Markman
(74) *Attorney, Agent, or Firm* — Rowand LLP

(57) ABSTRACT

A sanding device for sanding a workpiece. The sanding device includes a sanding block. The sanding block includes a right triangular block having a triangular base and a rectangular block having a rectangular base. The rectangular block may be affixed to a side surface of the right triangular block. The sanding block includes sanding block base surfaces having the triangular base abutting the rectangular base along a straight edge. The sanding block base surfaces include an abrasive surface and an engagement surface opposite the abrasive surface. The engagement surface includes a hand-shaped recess extending from the engagement surface towards the abrasive surface. The hand-shaped recess includes a thumb-shaped recess in the triangular base of the engagement surface and at least one non-thumb-shaped recess in the rectangular base of the engagement surface.

15 Claims, 6 Drawing Sheets

(56) References Cited

U.S. PATENT DOCUMENTS

| | | | | |
|---|---|---|---|---|
| 5,815,876 | A * | 10/1998 | Overseth | B24D 15/04 15/97.1 |
| 8,230,523 | B2 * | 7/2012 | Chareyron | A47L 13/18 2/160 |
| 9,555,275 | B1 * | 1/2017 | Izzolo, Jr. | B32B 3/14 |
| 2007/0136925 | A1 * | 6/2007 | Bell | A41D 19/01505 2/158 |
| 2012/0000001 | A1 * | 1/2012 | Powell | A41D 13/082 2/16 |
| 2013/0025023 | A1 * | 1/2013 | Anthony | A41D 19/01 2/161.6 |

* cited by examiner

SANDING DEVICES FOR SANDING A WORKPIECE

CROSS-REFERENCE TO RELATED APPLICATIONS

The present application claims priority to U.S. Provisional Patent Application No. 62/849,232, filed May 17, 2019, the contents of which are hereby incorporated by reference.

FIELD

The present application generally relates to sanding devices and, in particular, to a sanding block for sanding a workpiece.

BACKGROUND

Sandpaper is an abrasive material produced with a variety of grits. Sandpaper is commonly used to remove material from a workpiece surface to smooth out the workpiece surface. For instance, prior to installing cabinetry in a kitchen, sandpaper may be used to smooth out surfaces in preparation for painting of the cabinetry surfaces. In another example, material may be removed from the workpiece surface to make the workpiece surface rougher prior to adhering or adjoining the workpiece surface to another structure.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
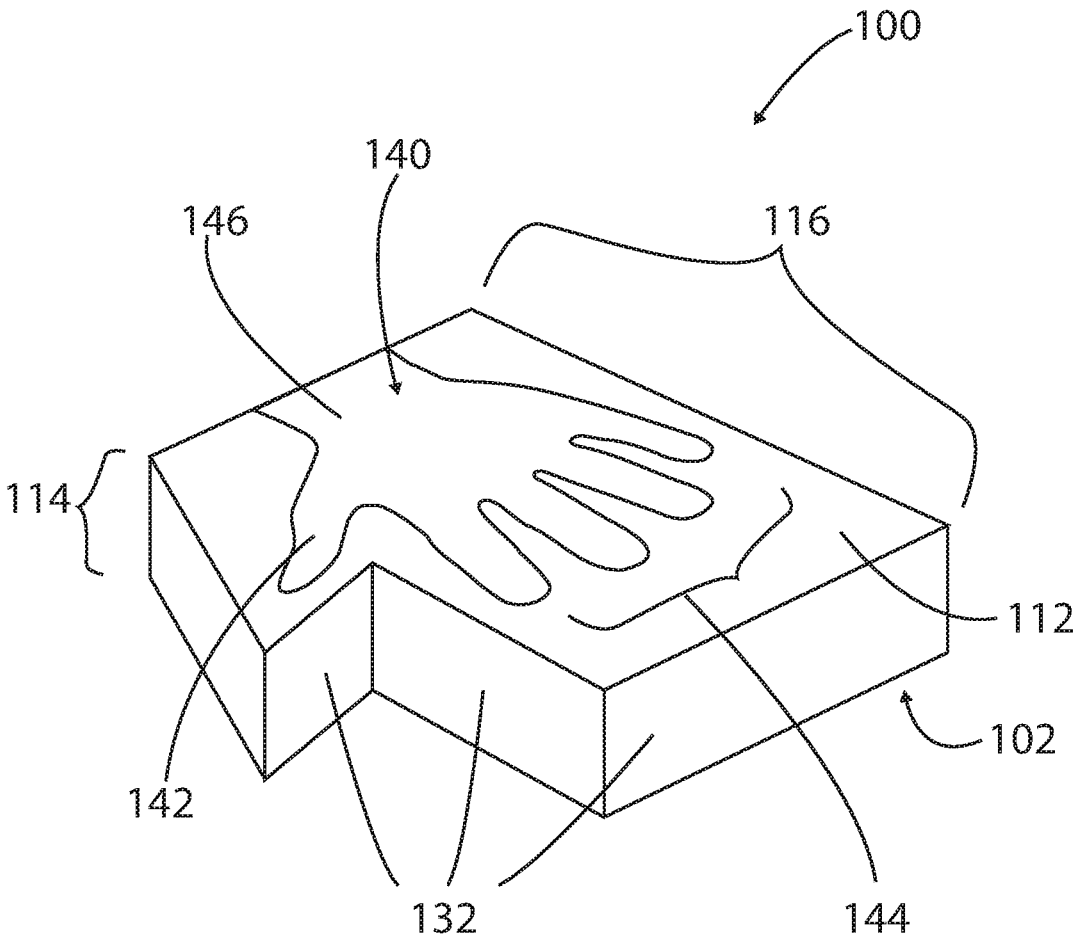
FIG. 1 illustrates a front perspective view of a sanding device, in accordance with an example of the present application.

Various examples and aspects of the present application will be described with reference to the details discussed herein. The following description and drawings are illustrative of the present application and are not to be construed as limiting the present application. Numerous details are described to provide a thorough understanding of various embodiments. However, in certain instances, well-known or conventional details are not described in order to provide a concise discussion of the embodiments of the present application.

The present application describes a sanding device for sanding a workpiece. The sanding device comprises: a sanding block including a triangular block having a triangular base and a rectangular block having a rectangular base.

The rectangular block is affixed to a side surface of the triangular block. The sanding block includes sanding block base surfaces having the triangular base abutting the rectangular base along a straight edge. The sanding block base surfaces include an abrasive surface and an engagement surface opposite the abrasive surface. The engagement surface includes a hand-shaped recess extending from the engagement surface towards the abrasive surface. The hand-shaped recess includes a thumb-shaped recess in the triangular base of the engagement surface and at least one non-thumb-shaped recess in the rectangular base of the engagement surface.

In some implementations, the hand-shaped recess may further include a palm-shaped recess in the rectangular base of the engagement surface. In some examples, the thumb-shaped recess, the at least one non-thumb-shaped recess, and the palm-shaped recess form a contiguous hand-shaped recess.

In some implementations, the sanding device may further include a glove received within the hand-shaped recess, wherein the finger-receiving portions of the glove abut the corresponding thumb-shaped recess and the at least one non-thumb-shaped recess of the hand-shaped recess. In some examples, the glove is removably fastened within the hand-shaped recess.

In some implementations, the rectangular block is removably affixed to the triangular block.

In some implementations, the triangular base is an obtuse triangle, and the rectangular block is affixed to the side surface of the triangular block corresponding to a first obtuse triangle edge opposite a first acute interior angle of the obtuse triangle. In some examples, the obtuse triangle includes a second obtuse triangle edge opposite a second acute interior angle of the obtuse triangle, and wherein an adjoining angle between the second obtuse triangle edge and the straight edge of the rectangular base is acute.

In some implementations, the hand-shaped recess includes four non-thumb-shaped recesses spread apart across the engagement surface.

In some implementations, side surfaces of the triangular block and side surfaces of the rectangular block are abrasive.

In some implementations, the abrasive surface includes at least one perforation. In some examples, the at least one perforation is coupled to a reservoir to dispense an additive substance to the workpiece.

In some implementations, the abrasive surface includes at least one of aluminum oxide, silicon carbide, zirconia alumina, ceramic alumina, emery, or garnet.

In some implementations, the sanding block is constructed of a foam core.

In some implementations, the abrasive surface includes at least one of open coat sandpaper or closed coat sandpaper.

In some implementations, the hand-shaped recess is mitt-shaped.

In another aspect, the present application provides a sanding device for sanding a workpiece. The sanding device may include a sanding block having at least one abrasive surface for sanding a workpiece and, opposite the at least one abrasive surface, an engagement surface defining a hand-shaped recess extending into the sanding block from the engagement surface towards the abrasive surface. The sanding block may include a first block portion in which a finger-portion of the hand-shaped recess is located and a sideways projecting second block portion in which a thumb-portion of the hand-shaped recess is located. In some cases, the first block portion is a rectangular block and wherein the second block portion is a triangular block. In some examples, a glove may be attached to the recess.

In yet another aspect, the present application provides a sanding device for sanding a workpiece. The sanding device may include a sanding block shaped to form a rectangular block and a sideways projecting triangular block, the rectangular block and the triangular block having sidewalls meeting at an acute angle, wherein the sanding block includes at least one abrasive surface on a bottom face and at least one abrasive surface on the sidewalls that meet at the acute angle. The sanding block may further define a recess on a top surface opposite the bottom surface.

Other aspects and features of the present application will be understood by those of ordinary skill in the art from a review of the following description of examples in conjunction with the accompanying figures.

In the present application, the terms "comprises" and "comprising" are intended to be inclusive and open ended, and not exclusive. Specifically, when used in the specification and claims, the terms "comprises" and "comprising" and variations thereof mean the specified features, steps, or components are included. These terms are not to be interpreted to exclude the presence of other features, steps, or components.

In the present application, the term "exemplary" means "serving as an example, instance, or illustration", and should not be construed as preferred or advantageous over other configurations disclosed herein.

In the present application, the terms "about", "approximately", and "substantially" are meant to cover variations that may exist in the upper and lower limits of the ranges of values, such as variations in properties, parameters, and dimensions. In a non-limiting example, the terms "about", "approximately", and "substantially" may mean plus or minus 10 percent or less.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

Sandpaper is commonly produced as a sheet material with abrasive surface. When an abrasive surface of sandpaper is in contact with a workpiece surface, the sandpaper may be used to remove material (e.g., existing paint, a layer of the workpiece surface, etc.) from the workpiece surface. A user may move sandpaper back and forth across the workpiece surface. For instance, the user may impart one or a combination of lateral or longitudinal force that is parallel to the workpiece surface for moving the sandpaper back and forth across the workpiece surface. Further, the user may press sandpaper against the workpiece surface (e.g., a force having at least one force component that is perpendicular to the workpiece surface) while imparting one or a combination of lateral or longitudinal force to the sandpaper to move the sandpaper across the workpiece surface.

In some examples, sandpaper may be wrapped around a sanding block, such as a piece of foam, a wooden block, or a cork block. In some examples, the sanding block may be a rectangular block. The user may grasp the sanding block to move the sandpaper across a workpiece surface. In doing so, the user may wrap fingers and/or portions of the palm about two or more sides of the sanding block structure and move the sanding block over the workpiece surface (e.g., akin to moving a chalkboard eraser over a chalkboard). Grasping the sanding block structure for long periods of time may cause fatigue in muscles of the user's hand, arm, or shoulder. Further, rectangular blocks may be unsuitable for sanding crevices of intricate workpiece surfaces or corner areas of a three-dimensional geometric structure (e.g., corners within a cabinet drawer or cupboard). It may be desirable to provide a sanding device to efficiently sand a workpiece surface while reducing muscle fatigue or reducing likelihood of injuries due to repetitive movement by a user of the sanding device.

It may be appreciated that while examples described herein of sanding devices may be used for sanding kitchen cabinetry, the example sanding devices described herein may also be used for wood-working projects, dry-walling projects, painting projects, fiberglass projects, automotive body shop projects, or other projects where a workpiece surface may need to be sanded.

Reference is made to FIG. 1, which illustrates a front perspective view of a sanding device 100, in accordance with an example of the present application. The sanding device 100 may be used for sanding a workpiece surface. A kitchen cabinet may be an example of a workpiece and kitchen cabinet surfaces may be workpiece surfaces. It may be understood that a workpiece may be any other structure having a surface to be sanded.

The sanding device 100 may include a sanding block having a geometric shape that includes a right triangular block and a rectangular block affixed to a side surface of the right triangular block. For example, a right triangular block may be a polyhedron made up of: (i) a triangular base, (ii) a spaced apart copy of the triangular base, and (iii) three sides joining corresponding sides of the triangular base and the spaced apart copy of the triangular base. It may be appreciated that the respective side surfaces of the right triangular block may be perpendicular to the triangular base.

Similarly, a rectangular block may be a polyhedron made of: (i) a rectangular base, (ii) a spaced apart copy of the rectangular base, and (iii) four sides joining corresponding sides of the rectangular base and the spaced apart copy of the rectangular base. In some examples, the sanding block may be constructed of a foam core. In other examples, other rigid or semi-rigid materials structural materials may be used for constructing the sanding block.

The sanding device 100 includes an abrasive surface 102 and an engagement surface 112 opposite the abrasive surface 102. In some examples, the abrasive surface 102 may include at least one or a combination of aluminum oxide, silicon carbide, zirconia alumina, ceramic alumina, emery, or garnet. It may be appreciated that the abrasive surface 102 may include other gritty materials or similar substance. In some examples, the abrasive surface 102 may include an open coat abrasive surface or a closed coat abrasive surface. That is, the abrasive surface 102 may include open coat sand paper or closed coat sandpaper.

In FIG. 1, the sanding device 100 includes sanding block base surfaces. The sanding block base surfaces includes the abrasive surface 102 and the engagement surface 112 opposite the abrasive surface 102. To illustrate, the engagement surface 112 may be spaced apart from the abrasive surface 102. Further, the respective sanding block base surfaces may collectively include a triangular base 114 and an abutting rectangular base 116. That is, a straight edge of the triangular base 114 may abut a straight edge of the rectangular base 116.

As described, when the sanding device 100 is used to sand a workpiece surface, the abrasive surface 102 may be in contact with and pressed against the workpiece surface. When a user imparts, to the sanding device 100, one or a combination of lateral or longitudinal forces that are parallel to the workpiece surface, the sanding device 100 may be pushed across the workpiece surface. Further, when the user imparts, to the sanding device 100, a force that includes a force component perpendicular to the workpiece surface (e.g., pressing sandpaper against the workpiece surface), the abrasive surface 102 may remove material from the workpiece surface.

To receive a user's hand for imparting force to the sanding device 100, the sanding device 100 includes a hand-shaped recess 140 extending from the engagement surface 112 towards the abrasive surface 102. In some examples, the hand-shaped recess 140 may include a thumb-shaped recess 142 in the triangular base 114 of the engagement surface 112 and at least one non-thumb-shaped recess 144 in the rectangular base 116 of the engagement surface 112. Further, the hand-shaped recess 140 may include a palm-shaped recess 146 substantially in the rectangular base 116 of the engagement surface 112. A user of the sanding device 100 may place the user's hand within the hand-shaped recess 140 and may impart, to the sanding device 100, force via the user's fingers and/or palm.

In the example illustrated in FIG. 1, the hand-shaped recess 140 includes the thumb-shaped recess 142, four non-thumb-shaped recesses 144, and a palm-shaped recess 146 spread apart across the engagement surface 112. The four non-thumb-shaped recesses 144 may be four finger-shaped recesses. As illustrated, the thumb-shaped recess 142, the at least one non-thumb-shaped recess 144, and the palm-shaped recess 146 may form a contiguous hand-shaped recess. The hand-shaped recess 140 may guide a user's interaction with the sanding device 100. That is, when a user is facing the engagement surface 112, the user may easily infer that respective fingers from the user's hand may be placed within respective portions of the hand-shaped recess 140.

When a user's hand is placed within the hand-shaped recess 140, the user may impart force to the sanding device 100. As the user's fingers are spread apart across the engagement surface 112, the imparted force may be spread over the engagement surface 112, as compared to simply imparting force to a localized region of the engagement surface 112. By guiding a user to spread fingers across the engagement surface 112, force from the user's hand may be distributed across the sanding device 100 and to the workpiece surface.

The sanding device 100 is illustrated as having a contiguous hand-shaped recess. In in some other examples, one or more of the thumb-shaped recess or the non-thumb-shaped recesses may be a localized recess (e.g., non-contiguous). That is, the thumb-shaped recess may be a distinct recess from one or more non-thumb-shaped recesses (e.g., akin to a plurality of crater type indentations in the engagement surface 112).

In the example illustrated in FIG. 1, when the user's hand is within the hand-shaped recess 140, the user need not focus on grasping the sanding device 100. That is, while the user's hand continues to be within the hand-shaped recess 140, as long as the user continues to press the sanding device 100 against a workpiece surface, the user does not need to actively grasp the sanding device 100.

The sanding device 100 includes a plurality of side surfaces (collectively illustrated in FIG. 1 with reference numeral 132). The respective side surfaces may join corresponding sides of the abrasive surface 102 and the engagement surface 112. That is, the respective side surfaces may be side surfaces of the right triangular block and the rectangular block. In some examples, one or more of the side surfaces may include a gritty surface and may be abrasive. That is, the one or more of the side surfaces may include at least one of aluminum oxide, silicon carbide, zirconia alumina, ceramic alumina, emery, or garnet.

As the abrasive surface 102 and one or more of the side surfaces 132 may be abrasive, the sanding device 100 may be used to simultaneously sand a first surface that may be perpendicular to a second surface. For example, a kitchen cabinet drawer may be a rectangular enclosure and the drawer may include a drawer corner where respective planar surfaces converge. In some scenarios, the sanding device 100 may be used to sand two or more surfaces simultaneously. That is, an abrasive side surface may be used to sand a first surface and the abrasive surface 102 may be used to sand a second surface using a single movement of the sanding device 100. It may be appreciated that portions of the engagement surface 112 may also be abrasive and may include gritty material or the like. That is, the exposed exterior surfaces of the sanding device 100 may be abrasive.

In FIG. 1, the sanding device 100 is configured to receive a left hand of a user. However, in some other examples, the right triangular block, the rectangular block, and the hand-shaped recess may be configured to receive a right hand of a user. That is, the right triangular block may be positioned on an opposite side of the rectangular block (as compared to that illustrated in FIG. 1) and the hand-shaped recess may include a recess pattern corresponding to a right hand of a user.

Figure 2:
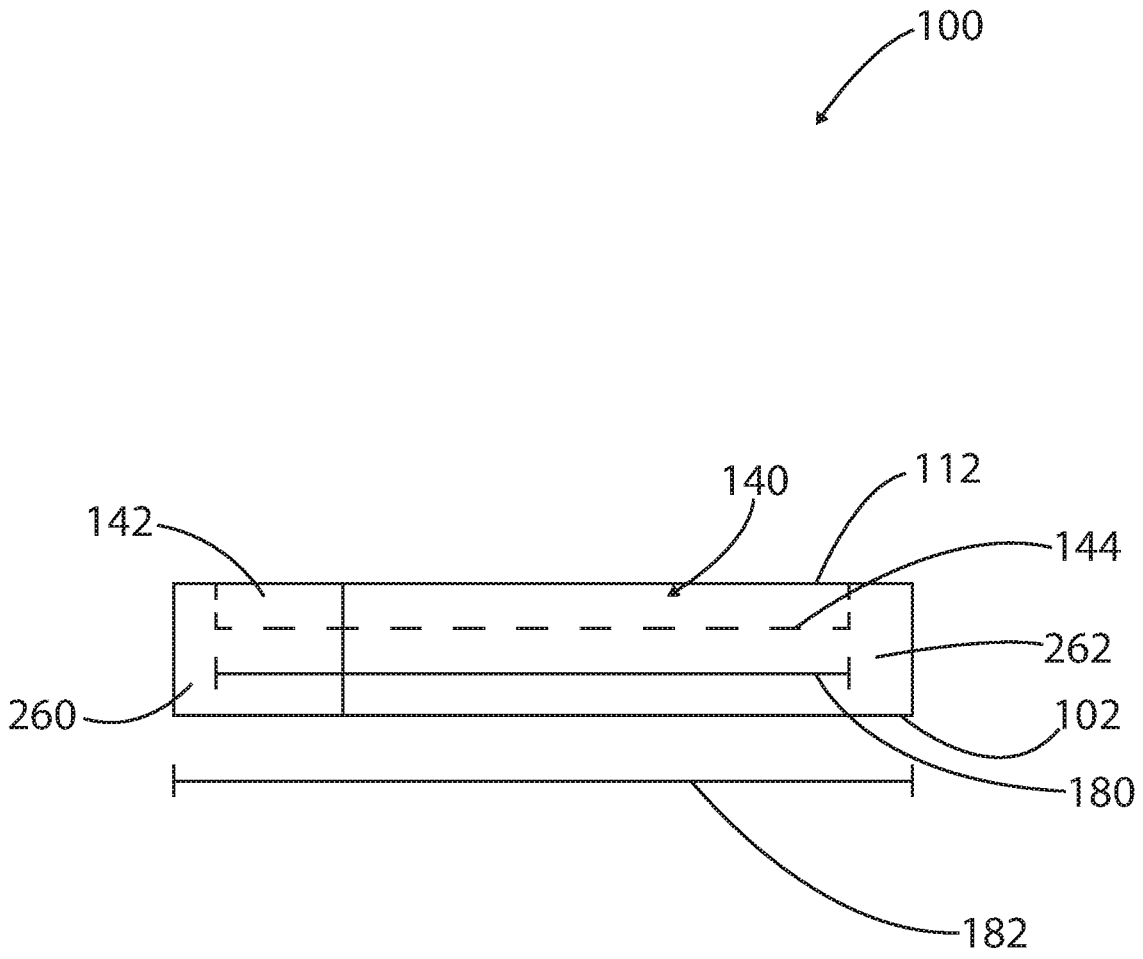
FIG. 2 illustrates a front elevation view of the sanding device of FIG. 1.

Reference is made to FIG. 2, which illustrates a front elevation view of the sanding device 100 of FIG. 1. The sanding device 100 includes the abrasive surface 102 and the engagement surface 112. Further, FIG. 2 illustrates a front view of the right triangular block 260 and the rectangular block 262 abutting or affixed to a side surface of the right triangular block 260.

The hand-shaped recess 140 is illustrated with dotted lines extending from the engagement surface 112 towards the abrasive surface 102. The hand-shaped recess 140 includes the thumb-shaped recess 142 associated with the right triangular block 260 and the at least one non-thumb-shaped recess 144 associated with the rectangular block 262.

In the example illustrated in FIG. 2, a maximum lateral width 180 of the hand-shaped recess 140 may be less than the overall lateral width 182 of the sanding device 100. Accordingly, a width of a sanding path of the sanding device 100 may be greater than a maximum lateral width 180 of a user's hand.

In some examples, the rectangular block 262 may be removably affixed to the right triangular block 260. For instance, the right triangular block 260 or the rectangular block 262 may be replaceable. In some scenarios, depending on the geometric shape of the workpiece surface, a user may find it desirable to affix the rectangular block 262 to a right triangular block that may have a different triangular base size or shape. The triangular base may be a right triangle base, an obtuse triangle base, or an acute triangle base. Further, the triangular base may have sides of different lengths or have interior angles having a variety of angles. It may be appreciated that the sanding device 100 may accommodate different triangular base sizes or shapes to correspond with the physical dimensions or constraints of a workpiece surface to be sanded. It may also be contemplated that depending on what portions of the sanding device 100 are used for sanding, an abrasive surface of the right triangular block 260 or the rectangular block 262 may experience greater wear (e.g., worn out) than the other of the right triangular block 260 or the rectangular block 262 (e.g., user may provide greater pressure using thumb than with non-thumb fingers of the hand) Thus, in some examples, it may be advantageous for the right triangular block 260 to be replaceable, as portions of the abrasive surface 102 corresponding to the right triangular block 260 may be worn out quicker than portions corresponding to the rectangular block 262.

In some examples, the rectangular block 262 may be affixed to the right triangular block 260 using a hook-and-loop fastener. Other types of fasteners for affixing the rectangular block 262 to the right triangular block 260 are contemplated. In some examples, the sanding device 100 may be a unitary block component that includes the right triangular block 260 and the rectangular block 262.

Figure 3:
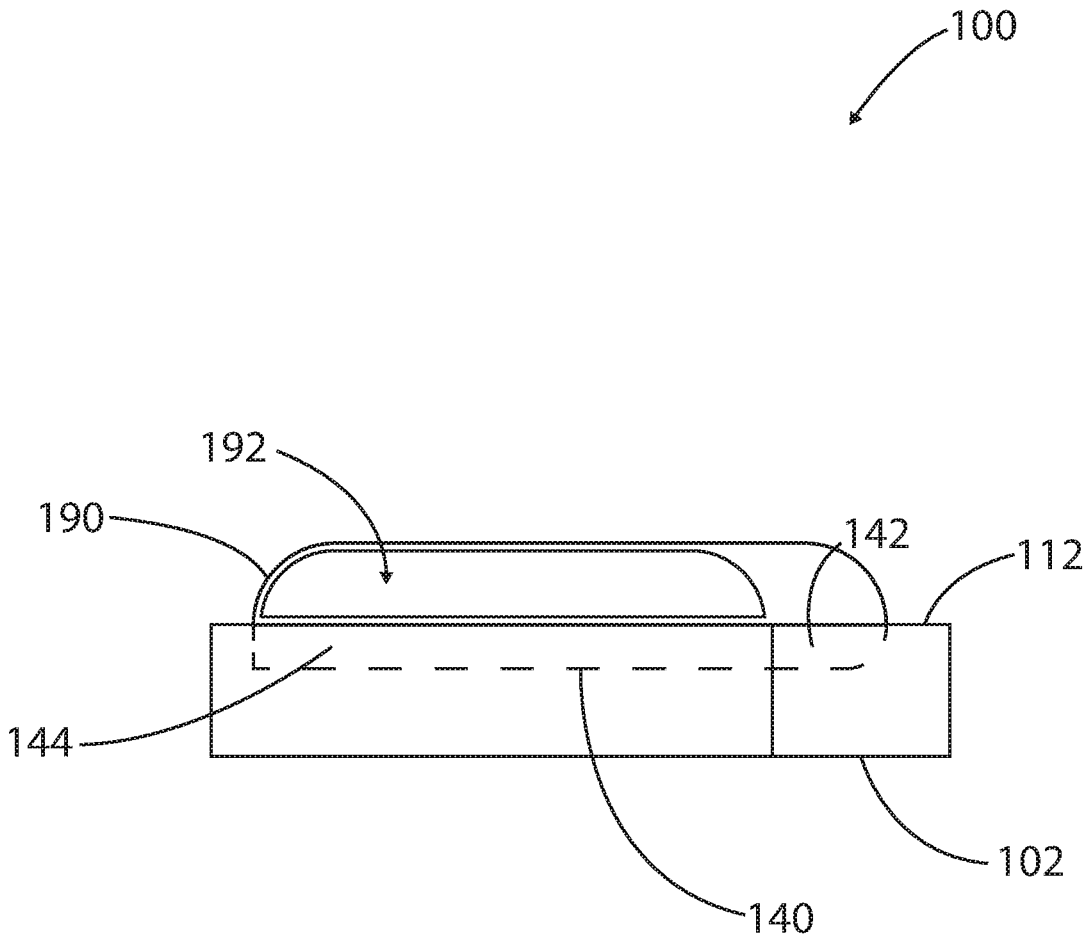
FIG. 3 illustrates a rear elevation view of the sanding device of FIG. 1.

Reference is made to FIG. 3, which illustrates a rear elevation view of the sanding device 100 of FIG. 1. FIG. 3 illustrates the abrasive surface 102 and the engagement surface 112 opposite the abrasive surface 102. FIG. 3 also illustrates the hand-shaped recess 140.

In some examples, the sanding device 100 may include a glove 190 received within the hand-shaped recess 140. A glove opening 192 is shown while the glove 190 is received in the hand-shaped recess 140. The thumb portion of the glove 190 may be received within the thumb-shaped recess 142 and the four non-thumb-shaped portions of the glove 190 may be received within the corresponding four non-thumb-shaped recesses 144, respectively.

In some examples, the glove 190 may be removably fastened within the hand-shaped recess 140. That is, a user may select the type of glove to be used with the sanding device 100. In some examples, the glove 190 may be removably fastened within the hand-shaped recess 140 using hook-and-loop fasteners. The palm side of the glove 190 may include one of hook or loops and the hand-shaped recess 140 may include opposing hook or loops such that the glove 190 may be removably fastened within the hand-shaped recess 140. Other types of fasteners or fastening mechanisms for removably fastening the glove 190 to the hand-shaped recess 140 may be contemplated.

Figure 4:
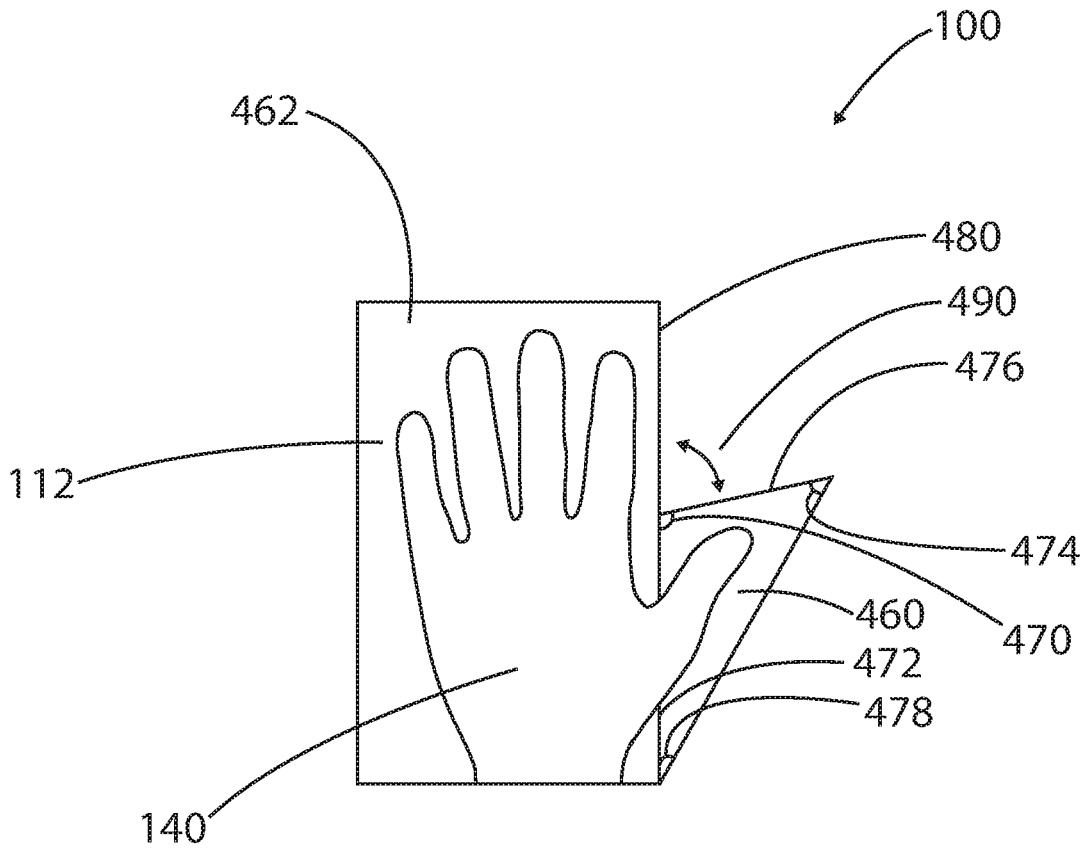
FIG. 4 illustrates a top view of the sanding device of FIG. 1.

Reference is made to FIG. 4, which illustrates a top view of the sanding device 100 of FIG. 1. The engagement surface 112 and the hand-shaped recess 140 is shown in FIG. 4. Further, the sanding block illustrated in FIG. 4 may have a geometric shape that includes a right triangular block 460 and a rectangular block 462 affixed to a side surface of the right triangular block 460.

In FIG. 4, the right triangular block 460 includes an obtuse triangle base. The obtuse triangle base includes an obtuse interior angle 470. The obtuse interior angle 470 is greater than 90 degrees. In the illustrated example, the rectangular block 462 is affixed to a side surface of the right triangular block 460 corresponding to a first obtuse triangle edge 472 that is opposite a first acute interior angle 474 of the obtuse triangle base.

Further, the obtuse triangle includes a second obtuse triangle edge 476 that is opposite a second acute interior angle 478 of the obtuse triangle base. In FIG. 4, the adjoining angle 490 between the second obtuse triangle edge 476 and a straight edge 480 of the rectangular base is an acute angle. The sanding device 100 may position a user's hand in a way that ergonomically promotes movement in a forward direction (e.g., upward page direction in FIG. 4). That is, the right triangular block 460 and the rectangular block 462 in combination with the hand-shaped recess 140 may position the user's index finger and thumb in an orientation that allows the user to slide the sanding device 100 back and forth, or side to side, over a workpiece surface. Other triangular base shapes and sizes are contemplated. For example, the right triangular block 460 may have a triangular base that is a right triangle (e.g., having one interior angle equal to 90 degrees).

It may be appreciated that a corner of the right triangular block 460 (e.g., proximal to the above-described first acute interior angle 474) may be used to sand crevices or otherwise narrow portions of the workpiece surface. In comparison, a corner of the rectangular block 462 may be less adept at reaching crevices or otherwise narrow portions of the workpiece surface.

Figure 5:
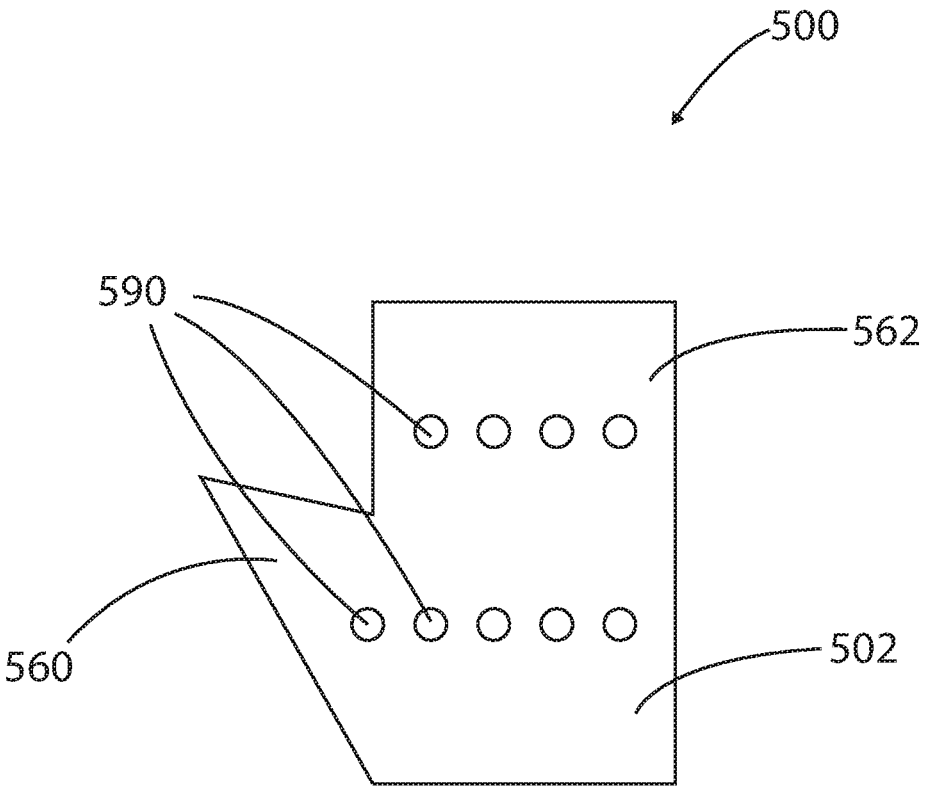
FIG. 5 illustrates a bottom view of a sanding device, in accordance with another example of the present application.

Reference is made to FIG. 5, which illustrates a bottom view of a sanding device 500, in accordance with an example of the present application. The sanding device 500 includes a right triangular block 560 having an obtuse triangle base. Further, the sanding device 500 includes a rectangular block 562 having a rectangular base. The rectangular block 562 may be affixed to a side surface of the right triangular block 560.

The sanding device 500 includes an abrasive surface 502 (illustrated in FIG. 5) and an engagement surface (not illustrated in FIG. 5). The example sanding device 500 may include at least one perforation 590 in the abrasive surface 502. That is, several perforations 590 may be positioned at a variety of positions spread about the abrasive surface 502. Other configurations or spacing patterns of the at least one perforation 590 may be contemplated. Perforations 590 having a circular shape (illustrated in FIG. 5), triangular shape, or any other shape may be contemplated.

Further, the at least one perforations 590 may be coupled to a reservoir to dispense an additive substance to the workpiece surface. In some examples, the at least one perforation 590 may be coupled to a reservoir via one or a network of tubes. In some examples, the reservoir may be worn on the user's arm or worn as a backpack. The at least one perforation 590 may be used to dispense an additive substance to the workpiece surface. As an example, the additive substance may be a fluid for cooling the workpiece surface, as heat may be generated by friction between the sanding device 500 and the workpiece surface. In another example, the additive substance may be a priming fluid. That is, the workpiece surface may be substantially primed while being sanded.

Figure 6:
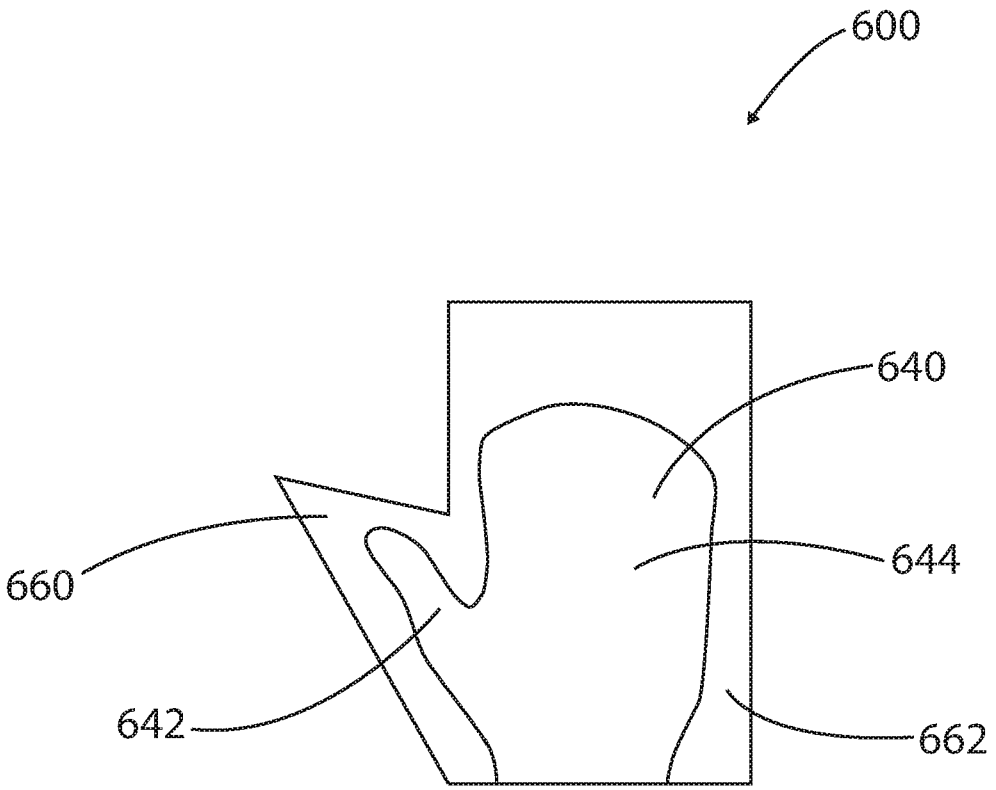
FIG. 6 illustrates a top view of a sanding device, in accordance with another example of the present application.

Reference is made to FIG. 6, which illustrates a top view of a sanding device 600 in accordance with another example of the present application. The sanding device 600 includes a sanding block surface having a right triangular block 660 and a rectangular block 662 being affixed to a side surface of the right triangular block 660. The sanding device 600 may be configured to receive a right hand of a user.

The sanding device 600 includes a mitt-shaped recess 640. The mitt-shaped recess 640 includes a thumb-shaped recess 642 in a triangular base of the triangular block 660 and a non-thumb recess 644 in a rectangular base of the rectangular block 662. The non-thumb recess 644 may accommodate users having different hand sizes, where respective users may freely spread fingers across the non-thumb recess 644. Where the hand-shaped recess 140 of FIG. 1 may provide designated recess portions for specific fingers, a user with various hand sizes may encounter challenges spreading fingers within the example hand-shaped recess 140 of FIG. 1. In contrast, the example sanding device 600 of FIG. 6 may allow a user to self-adjust the position of fingers within the non-thumb recess 644. Further, in some examples, the sanding device 600 may include a mitt (not illustrated) received within the mitt-shaped recess 640.

Certain adaptations and modifications of the described embodiments may be made. Therefore, the above discussed embodiments are considered to be illustrative and not restrictive.

What is claimed is:

1. A sanding device for sanding a workpiece, the sanding device comprising:

a sanding block including:

a triangular block having a triangular base; and a rectangular block having a rectangular base, the rectangular block being affixed to a side surface of the triangular block, wherein the sanding block includes sanding block base surfaces having the triangular base abutting the rectangular base along a straight edge, the sanding block base surfaces being an abrasive surface and an engagement surface opposite the abrasive surface, and wherein the engagement surface includes a hand-shaped recess extending from the engagement surface towards the abrasive surface, and wherein the hand-shaped recess includes a thumb-shaped recess in the triangular base of the engagement surface and at least one non-thumb-shaped recess in the rectangular base of the engagement surface, and wherein side surfaces of the triangular block and side surfaces of the rectangular block are abrasive.

2. The sanding device of claim 1, wherein the hand-shaped recess further includes a palm-shaped recess in the rectangular base of the engagement surface.

3. The sanding device of claim 2, wherein the thumb-shaped recess, the at least one non-thumb-shaped recess, and the palm-shaped recess form a contiguous hand-shaped recess.

4. The sanding device of claim 1, further comprising a glove within the hand-shaped recess.

5. The sanding device of claim 4, wherein the glove is removably fastened within the hand-shaped recess.

6. The sanding device of claim 1, wherein the rectangular block is removably affixed to the triangular block.

7. The sanding device of claim 1, wherein the triangular base is an obtuse triangle, and wherein the rectangular block is affixed to the side surface of the triangular block corresponding to a first obtuse triangle edge opposite a first acute interior angle of the obtuse triangle.

8. The sanding device of claim 7, wherein the obtuse triangle includes a second obtuse triangle edge opposite a second acute interior angle of the obtuse triangle, and wherein an adjoining angle between the second obtuse triangle edge and the straight edge of the rectangular base is acute.

9. The sanding device of claim 1, wherein the hand-shaped recess includes four non-thumb-shaped recesses spread apart across the engagement surface.

10. The sanding device of claim 1, wherein the abrasive surface includes at least one perforation.

11. The sanding device of claim 10, wherein the at least one perforation is coupled to a reservoir to dispense an additive substance to the workpiece.

12. The sanding device of claim 1, wherein the abrasive surface includes at least one of aluminum oxide, silicon carbide, zirconia alumina, ceramic alumina, emery, or garnet.

13. The sanding device of claim 1, wherein the sanding block is constructed of a foam core.

14. The sanding device of claim 1, wherein the abrasive surface includes at least one of open coat sandpaper or closed coat sandpaper.

15. The sanding device of claim 1, wherein the hand-shaped recess is mitt-shaped.

* * * * *